United States Patent [19]

Profera, Jr.

[11] Patent Number: 4,996,535

[45] Date of Patent: Feb. 26, 1991

[54] SHORTENED DUAL-MODE HORN ANTENNA

[75] Inventor: Charles E. Profera, Jr., Cherry Hill, N.J.

[73] Assignee: General Electric Company, East Windsor, N.J.

[21] Appl. No.: 241,671

[22] Filed: Sep. 8, 1988

[51] Int. Cl.[5] ..... H01Q 13/00

[52] U.S. Cl. ..... 343/786; 343/772; 333/21 A; 333/21 R

[58] Field of Search ..... 343/786, 772, 778; 333/21 A, 21 R

[56] References Cited

U.S. PATENT DOCUMENTS

| | | | |
|---|---|---|---|
| 3,351,944 | 11/1967 | Dunn et al. | 343/786 |
| 3,458,862 | 7/1969 | Franks | 343/786 |
| 3,662,393 | 5/1972 | Cohn | 343/786 |
| 4,041,499 | 8/1977 | Liu et al. | 343/786 |
| 4,200,870 | 4/1980 | Gabbitas | 343/786 |
| 4,658,258 | 4/1987 | Wilson | 343/786 |
| 4,757,326 | 7/1988 | Profera | 343/786 |

*Primary Examiner*—Rolf Hille
*Assistant Examiner*—Hoanganh Le
*Attorney, Agent, or Firm*—William H. Meise

[57] ABSTRACT

A hollow waveguide includes a conductive peripheral wall arrangement centered on a longitudinal axis. The waveguide is short-circuited at a first transverse plane. A center conductor is connected to the short-circuit and extends along the longitudinal axis to an abrupt open circuit termination at a second transverse plane. The arrangement is fed at a location between the first and second transverse planes to produce both a fundamental waveguide mode and a center-conductor coupled mode. The fundamental mode has an amplitude taper in the horizontal direction but not in the vertical direction. At the abrupt termination, a higher-order waveguide mode is generated which, when phase-shifted by 180°, provides an amplitude taper in a vertical direction. A radiating aperture located near the 180° phase shift point produces a radiation pattern which is similar in both the verticla and horizontal planes.

7 Claims, 9 Drawing Sheets

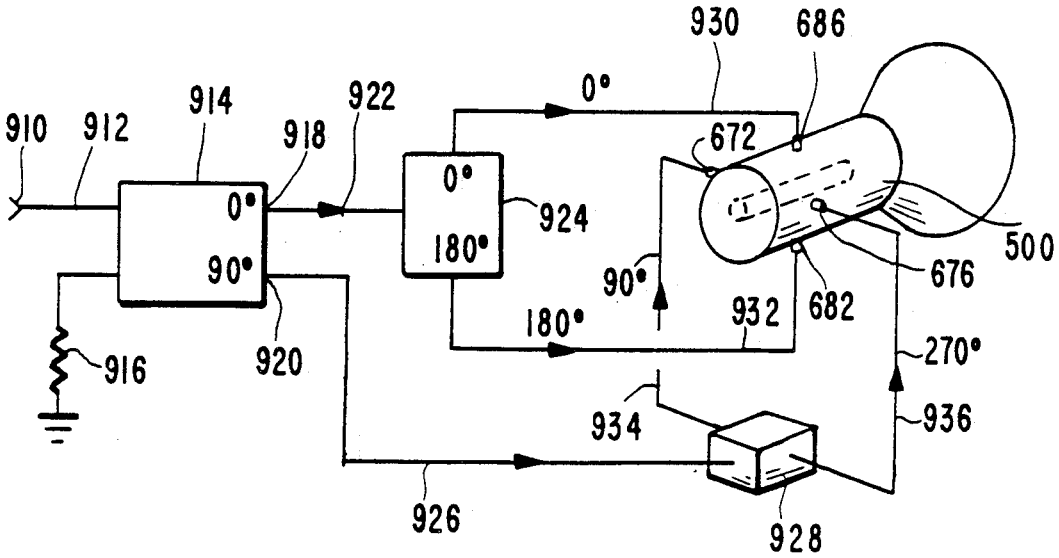
FIG. 9a
FIG. 9b
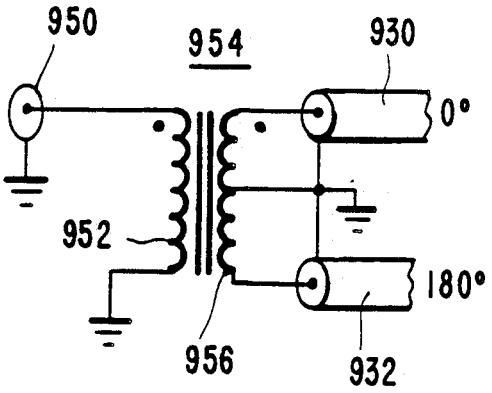

SHORTENED DUAL-MODE HORN ANTENNA

This invention relates to radiating waveguide apertures for horn antennas of the dual-mode type.

There are many applications for which antennas having shaped radiation patterns are desirable. For example, shaped beam antennas for communications applications use offset reflectors and multiple element array feeds. For microwave applications, the array feed elements are often in the form of waveguide horns. The gain of a shaped beam reflector antenna is dependent upon the radiation properties of the individual feed horn antennas of the array, which in turn depends upon the illumination of the aperture of each horn of the array. Those skilled in the antenna arts know that transmitting and receiving characteristics of an antenna are reciprocal functions. That is, the antenna gain when the antenna is performing a transmitting function is the same as the gain when performing a receiving function. Many other antenna characteristics are also identical in both transmitting and receiving modes, but the descriptions are often couched only in terms of transmission. The "illumination" of an aperture may be thought of as the energy density distribution at the radiating opening (or alternatively at the energy-collecting opening) of the antenna. In a horn antenna, the radiating aperture is normally the large open end, corresponding to an open end of a trumpet. Thus, the illumination is the electromagnetic energy distribution within the opening of the horn. For simplicity and reliability in the arraying of radiating apertures, it is often desirable to have a radiation pattern which is identical or at least similar in at least two orthogonal planes. For example, it may be desirable that the radiation pattern in a first plane for a given polarization be the same as the radiation pattern in a second plane orthogonal to the first, for a polarization orthogonal to the first.

As mentioned above, the radiated beam shape depends upon the aperture illumination or energy distribution. It is well known that a relatively large aperture is capable of producing a relatively narrow radiated beam. Such a narrow radiated beam corresponds to an antenna having high directivity, and is ordinarily associated with high antenna gain. High gain or high directivity of an antenna is a desirable characteristic for some purposes. High directivity for a given aperture occurs when the aperture is fully illuminated, while lower gain occurs if the large aperture is not fully illuminated, because a portion of the aperture is not utilized in developing the radiation pattern. A tapered energy distribution which does not fully utilize the entire aperture can provide a radiation pattern in which the side lobe level (energy radiated in directions other than the preferred direction) is much lower than for an aperture which is illuminated with equal energy at all points.

A radiating aperture such as the open end of a rectangular waveguide illuminated with energy in the principal field configuration, known as the $TE_{1,0}$ mode, has an electric field distribution which is uniform in the direction parallel to the electric field lines (the "vertical" or "E" direction). Because the electric field lines cannot exist parallel to a conductive wall, the $TE_{1,0}$ field distribution in a direction orthogonal to the electric field lines (the "horizontal" or "H" direction) is approximately sinusoidal. The uniform vertical illumination results in a relatively narrow main beam in the E plane with relatively large-amplitude side lobes in the far-field radiated pattern, while in the horizontal plane the tapered illumination results in a somewhat broader radiated pattern with lower side lobes.

For good circular polarization patterns, it is desirable that the radiation patterns in the vertical and horizontal planes be similar. In order to make the vertical and horizontal radiation patterns more similar, the prior art uses a mode generating step for generating a higher-order waveguide mode. The higher-order mode has components which when added to the fundamental mode in one plane tends to make the aperture distribution in that plane more similar to the aperture distribution in the other plane. The fundamental mode and the higher-order mode have different phase velocities when propagating through the waveguide, which means that the phase shift per unit of distance along the waveguide differs as between the modes. In prior art arrangements for using mode generators for tapering the energy distribution, the higher-order modes are generated by a step in the dimensions of the waveguide, and are generated in-phase with the fundamental mode. As it so happens, the desired relative phase between the higher-order and the fundamental modes at the radiating aperture is also in-phase, but the radiating aperture cannot be at the mode generating step because of the existence of evanescent modes, and also because slight errors in dimension due to tolerances could substantially affect the energy distribution in the aperture. Consequently, a length of waveguide must be placed between the mode-generating step and the radiating aperture, to provide a differential phase equal to 360° between the fundamental and higher-order modes. This requirement for a 360° differential phase therefore results in an increased size and weight of the horn. The additional size and weight is a problem which is exacerbated when many such horns are used in an array. The long path length also reduces the instantaneous frequency bandwidth of the horn.

SUMMARY OF THE INVENTION

A horn antenna arrangement includes a hollow waveguide defined by a conductive wall arrangement centered on a longitudinal axis. A conductive short-circuiting plate is connected to close off the hollow waveguide at a first transverse plane. An elongated center conductor is connected at one end to the short circuiting plate and extends within the hollow waveguide and centered on the axis to a second transverse plane, at which it abruptly terminates. A push-pull feed arrangement is coupled to the hollow waveguide at a third transverse plane lying between the first and second transverse planes. The feed arrangement is adapted for receiving signal and for coupling the signal into the waveguide by first and second electric poles located at diametrically opposite sides of the axis. A radiating aperture is centered on the axis and is coupled to an extension of the hollow waveguide projecting beyond the second transverse plane. The abrupt termination of the center conductor is a mode generating step which generates the higher-order mode at a relative phase of 180° relative to the fundamental, so that the length of the additional extension of waveguide needs to provide a differential phase of only 180° rather than 360°, resulting in a shorter, lighter weight horn with wider instantaneous frequency bandwidth. In a particular embodiment, two orthogonal feeds are provided in phase quadrature to generate (or receive) circular polarization.

DESCRIPTION OF THE DRAWING

FIGS. 1*a* and 1*b* are together referred to as FIG. 1;

FIGS. 2*a* and 2*b* are together referred to as FIG. 2;

FIGS. 7*a* and 7*b* are together referred to as FIG. 7;

FIG. 9*a* illustrates in block diagram form an arrangement for feeding the antenna arrangements of FIGS. 5 or 7 to produce circular polarization, and FIG. 9*b* schematically illustrates a detail of a portion of the arrangement of FIG. 9*a*.

DESCRIPTION OF THE INVENTION

Figure 1B:
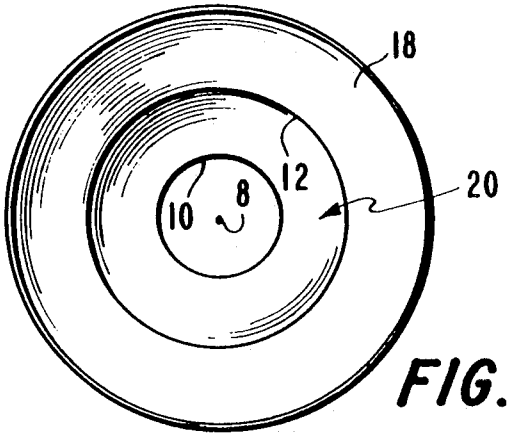
FIG. 1*b* is an end view thereof.
Figure 1A:
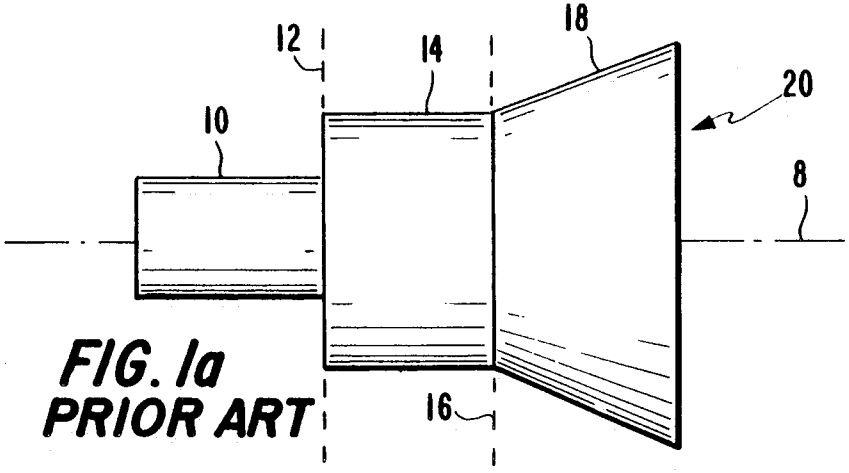
FIG. 1a PRIOR ART
FIG. 1*a* is an elevation view of a prior art circular horn antenna arrangement including a mode-generating step change in the size of the feed waveguide.

FIG. 1*a* is an elevation view of a horn antenna arrangement according to the prior art. In FIG. 1*a*, a portion 10 of hollow circular waveguide is fed from the left by a source (not illustrated), and makes a step transition in size at a plane 12 transverse to an axis 8 into a larger section of circular waveguide 14. The axial length of circular waveguide section 14 is predetermined as described below, and ends at a second transverse plane 16. The radiating aperture can occur at transverse plane 16, or, as illustrated in FIG. 1*a*, a circular horn section 18 may be coupled to waveguide section 14 at transverse plane 16 for increasing the size of the radiating aperture, illustrated in FIG. 1*a* as 20. FIG. 1*b* is an end view of the structure of FIG. 1*a* looking into aperture 20.

Figure 3A:
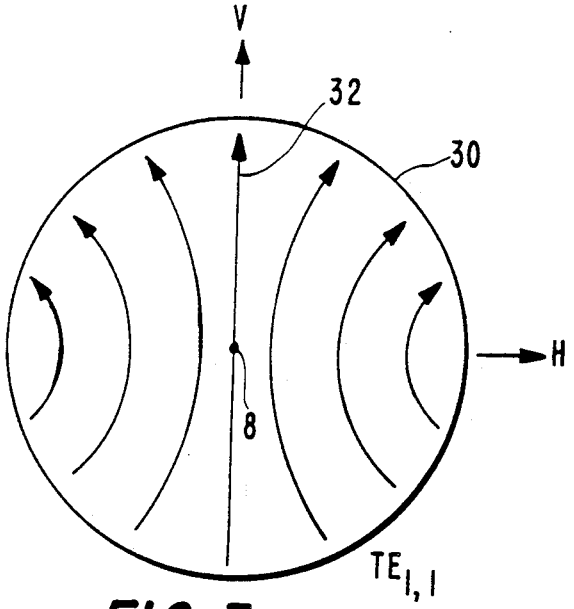
FIG. 3*a* illustrates the electric field configuration of the principal $TE_{1,1}$ mode in circular waveguide.

The signal applied from the source (not illustrated) to the left of waveguide portion 10 of FIG. 1*a* is in the principal $TE_{1,1}$ mode. FIG. 3*a* illustrates the instantaneous electric (E) field configuration within a circular waveguide represented by a circle 30. Those skilled in the art know that such instantaneous representation change with time in a cyclical manner. As illustrated by arrows 32 in FIG. 3*a*, the net electric field is vertically directed. As is known to those skilled in the art, the electric field lines 32 cannot have components parallel to and in contact with conductive walls such as wall 30, and therefore terminate thereon orthogonally. While FIG. 3*a* illustrates the direction of the field lines, no information is provided in FIG. 3*a* relating to the amplitude of the field distribution. The central electric field line 32 illustrated in FIG. 3*a* represents the largest magnitude. A vertical (V) plane is defined parallel to a central electrical field line 32 and axis 8, and a horizontal (H) plane is defined parallel to axis 8 and orthogonal to the vertical plane. At least near the central vertical plane in the arrangement of FIG. 3*a*, there is little or no amplitude taper of the field distribution within waveguide 30. In the horizontal plane, however, the largest amplitude corresponds to a central position such as that occupied by electric field line 32, and the electric field amplitude decreases to the right and left of central axis 8, reaching essentially zero amplitude at the walls of 30 of the waveguide. The amplitude distribution is approximately half-sinusoidal.

As is well known to those skilled in the art, the orientation of the electric field illustrated in FIG. 3*a* is only one of an infinite number of possible orientations which result from the circular symmetry of the waveguide. Those skilled in the art also know that two mutually orthogonal $TE_{1,1}$ modes can propagate in the same waveguide if their relative phase is at, or close to, 90°. Such pairs of phase-quadrature propagations are often termed elliptical or circular polarization. However, only one such orientation needs to be illustrated for full description.

Figure 3B:
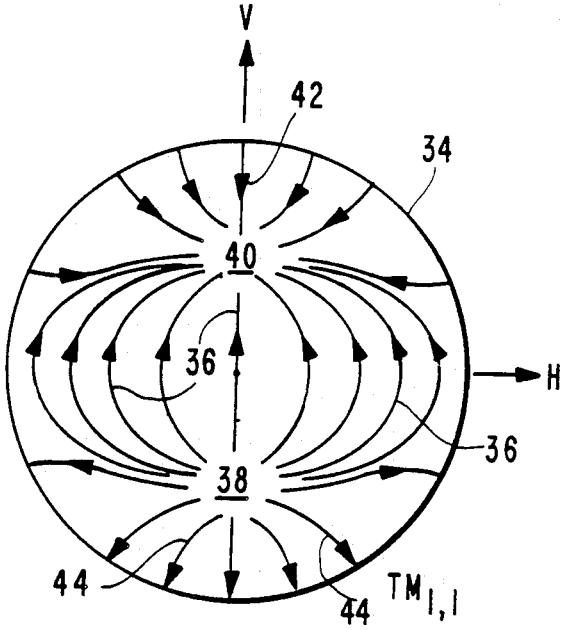
FIG. 3*b* illustrates the electric field configuration of the higher-order $TM_{1,1}$ mode in circular waveguide.

At the step change in dimensions corresponding to transverse plane 12 of FIG. 1*a*, some of the energy propagating from the source toward radiating aperture 20 is converted to the $TM_{1,1}$ mode. FIG. 3*b* is an instantaneous illustration of the $TM_{1,1}$ mode. In FIG. 3*b*, the conductive wall of larger waveguide 14 is illustrated as 34. As in FIG. 3*a*, the electric field lines terminate orthogonally on walls 34. It should be remembered that within larger-size waveguide 14 of FIG. 1, two modes propagate simultaneously, namely the $TE_{1,1}$ mode (FIG. 3*a*) and the $TM_{1,1}$ mode (FIG. 3*b*). The mode generating step in FIG. 1*a* occurs at transverse plane 12. At transverse plane 12, the $TM_{1,1}$ mode generated by the step has the phase illustrated in FIG. 3*b* relative to the principal mode $TE_{1,1}$ as illustrated in FIG. 3*a*. In FIG. 3*b*, some centrally located electric field lines illustrated as 36 extend between a lower node 38 and an upper node 40. Other electric field lines illustrated as 42 and 44 extend from walls 34 to upper node 40 and to lower node 38, respectively. The general direction of electric field lines 42 and 44 is oppositely directed to that of electric field lines 36. Also, it should be noted that electric field lines 42 and 44 extend from nodes 40 and 38, respectively to terminate orthogonally on conductive wall 44 and at nodes 40 and 48, respectively. Thus, electric field lines 42 and 44 represent a more or less constant amplitude distribution in the vertical direction at locations above node 40 and below node 38. Electric field lines 36 represent a more or less constant amplitude distribution in the vertical direction, but are parallel to conductive wall 34, and consequently represent a tapered amplitude distribution in the horizontal direction.

Figure 3C:
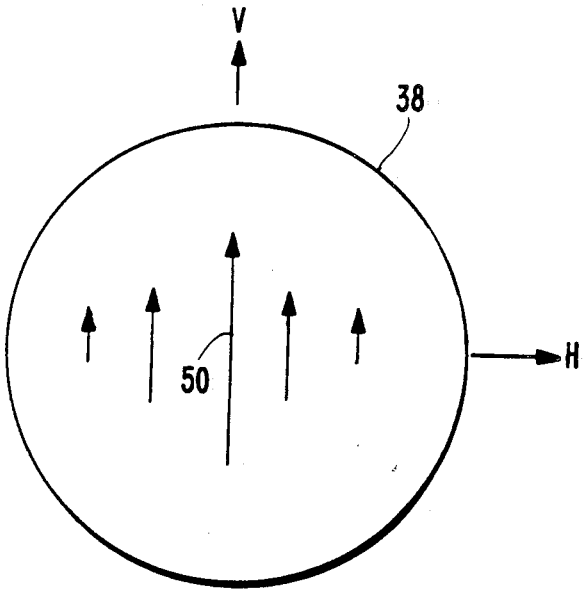
FIG. 3*c* illustrates the summation of the field configurations illustrated in FIGS. 3*a* and 3*b*, FIGS. 3*a*, 3*b* and 3*c* are referred to together as FIG. 3.

FIG. 3*c* illustrates generally the instantaneous result of superposition of the modes illustrated in FIGS. 3*a* and 3*b* at a location at or near radiating aperture 20. Radiating aperture 20 is at a distance from plane 12 of the mode generating step, which distance corresponds to a 360° differential phase, whereby the relative phases of the $TE_{1,1}$ and the $TM_{1,1}$ modes are as illustrated in FIGS. 3*a* and 3*b*. As illustrated in FIG. 3*c*, the central vertically directed electric field line 50 does not extend all the way to the conductive wall 38, thereby suggesting an amplitude which has been tapered in the vertical direction. This results from cancellation of upwardly-directed central electric field line 32 of FIG. 3*a* near the top and bottom of the waveguide by electric field lines 42 and 44 of FIG. 3*b*, which are oppositely directed. In the central region of the waveguide, however, electric field 36 of the $TM_{1,1}$ mode of FIG. 3*b* has the same direction as electric field 32 of the $TE_{1,1}$ mode of FIG. 3*a*, and therefore is additionally phased to produce electric field lines 50 of FIG. 3*c*. The electric field lines 32 of FIG. 3*a* are curved to indicate their direction. This illustration of FIG. 3*a* gives no hint of the amplitude distribution, but it is noted that both the electric field lines 32 of FIG. 3*a* and 36 of FIG. 3*b* have an amplitude taper, being a maximum near the center of the waveguide and tapering to zero amplitude at the right and left extremes. Thus, their superposition as illustrated in FIG. 3*c* has the longest electric field lines in the center, representing maximum amplitude, and shorter electric field lines to the right and left, representing a lesser amplitude, thereby illustrating an amplitude taper in the horizontal direction. Furthermore, the general direction of curvature of electric field lines 32 is opposite to that of electric field lines 36 of FIG. 3*b*, with the result that their sum tends to be straight. An energy distribution at the radiating aperture which is tapered in amplitude both in the vertical as well as in the horizontal planes as illustrated in FIG. 3*c* tends to provide more equal beam patterns in the vertical and horizontal directions than the fundamental mode illustrated in FIG. 6*a*, which is tapered only in the horizontal plane.

As mentioned, the presence of evanescent modes near transverse plane 12 of FIG. 1*a* prevents placing the radiating aperture precisely at that plane. However, the desired phase distribution as illustrated in FIGS. 3*a* and 3*b* for the principal and higher-order mode is correct at transverse plane 12. Consequently, the electrical length of waveguide section 14 of FIG. 1*a* (and of horn section 18, if used) must be selected to be 360° or N times 360°, where N is an integer, in order to obtain the relative phases illustrated in FIGS. 3*a* and 3*b* at radiating aperture 20 greatest bandwidth is achieved when N=1.

Figure 2B:
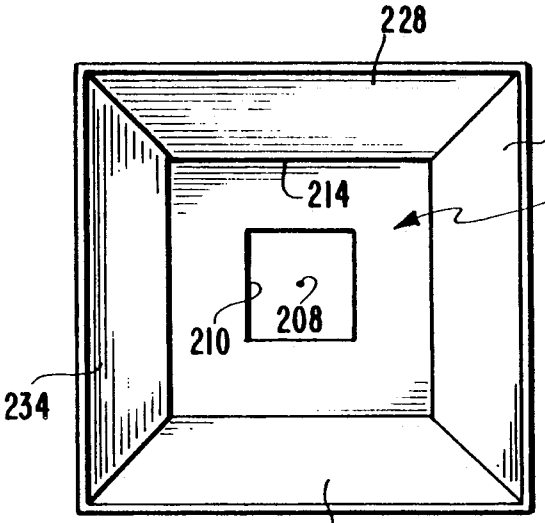
FIG. 2*b* is an end view thereof.
Figure 2A:
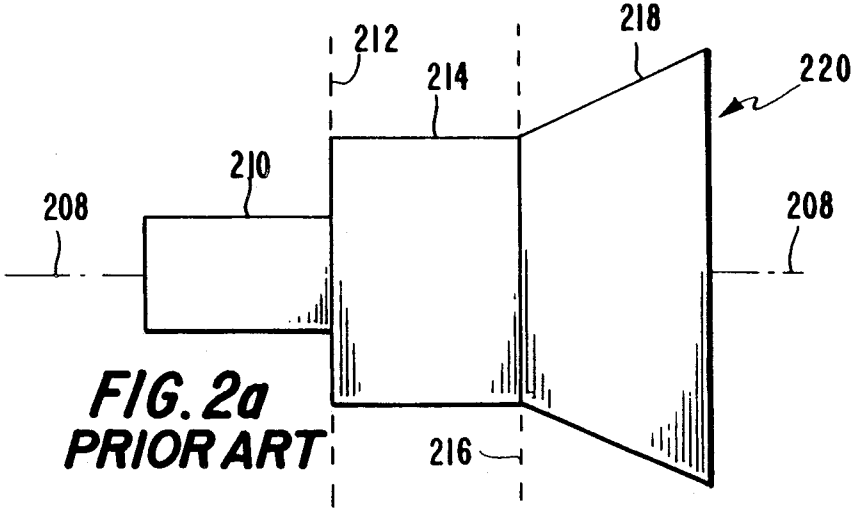
FIG. 2a PRIOR ART
FIG. 2*a* is an elevation view of a prior art square horn antenna arrangement including a mode-generating step in the dimensions of the feed waveguide.

FIG. 2*a* illustrates an elevation view of a prior art antenna arrangement including a portion 210 of square waveguide with a transition at a transverse plane 212 to a portion 214 of a larger square waveguide. Square waveguide portion 214 makes a transition at a transverse plane 216 to a flared horn 218 which terminates at a radiating aperture 220. As illustrated in FIG. 2*b*, flared horn 218 includes sides 228, 230, 232 and 234.

Figure 4A:
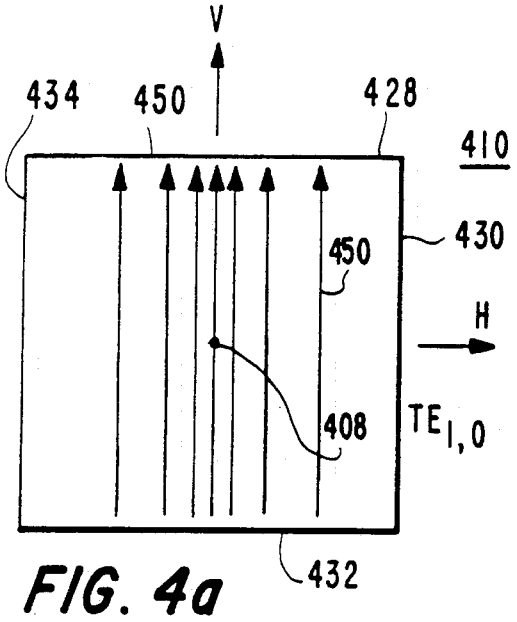
FIG. 4*a* illustrates the electric field configuration of the principal $TE_{1,0}$ mode in square waveguide.

FIG. 4*a* illustrates the instantaneous electric field distribution of the signal propagating in the $TE_{1,0}$ mode in a square waveguide 410 with conductive walls illustrated as 428, 430, 432 and 434. As illustrated in FIG. 4*a*, the electric field lines are vertical and extend from the lower wall 432 to upper wall 428. Unlike the circular waveguide and horn, which provide an infinite number of possible orientations of the field, a square waveguide or horn have only two possible orientations, one of which is illustrated in FIG. 4*a*, the other (not illustrated) being orthogonal thereto. As mentioned in conjunction with FIG. 3, electric field lines cannot exist parallel to a conductive wall. Consequently, electric field lines 450 in FIG. 4*a* cannot exist parallel to conductive walls 430 and 434. This results in an approximately half-sinusoidal amplitude distribution in the horizontal direction as is described in U.S. Pat. No. 4,556,853 issued Dec. 3, 1985 to Clark. The amplitude distribution is suggested in FIG. 4*a* by the greater density of electric field lines 450 near the central vertical axis passing through longitudinal axis 408.

Figure 4B:
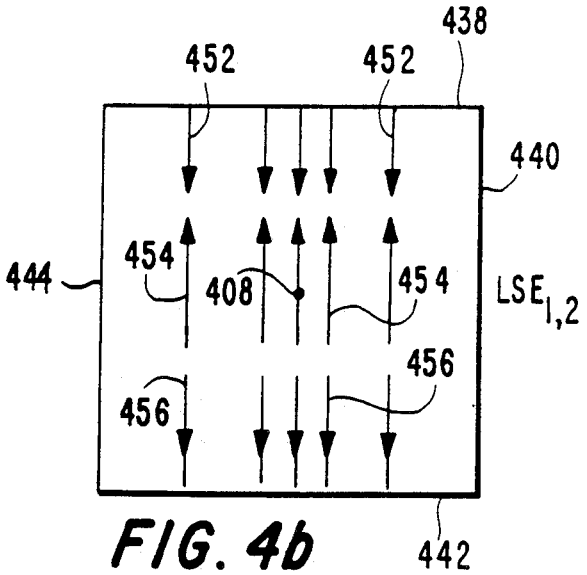
FIG. 4*b* illustrates the electric field configuration of the higher-order $LSE_{1,2}$ mode in square waveguide.

FIG. 4*b* illustrates the electric field configuration of a higher-order mode which may coexist with the fundamental $TE_{1,0}$ mode at a location within large-size waveguide 214 of FIG. 2 near the mode-generating step at plane 212. The higher-order mode is a hybrid of $TE_{1,2}$ and $TM_{1,2}$ modes, which may be termed an $LSE_{1,2}$ mode. This term LSE stands for Longitudinal Section E-mode, which is a mode in which a longitudinal section of the waveguide (as opposed to the transverse sections illustrated in FIGS. 3 and 4) has no electric field lines perpendicular to the plane of the section. The subscript 1,2 refers to the number of half-cycles in the H and V directions, respectively, as seen in the transverse section. In FIG. 4*b*, downwardly-directed arrows 452 with their tails connected to upper wall 438 and arrows 456 with their heads connected to lower wall 442 each represent one quarter cycle for a total of one half cycle of amplitude=de variation in the vertical direction, and upwardly-directed arrows 454 represent one half cycle of amplitude variation in the vertical direction. Thus, there are a total of two half-cycles of amplitude variation in the vertical direction, corresponding to the "2" subscript of the designation $LSE_{1,2}$. All of the electric field lines 452, 454 and 456 are parallel to side walls 440, 444 of the larger square waveguide, and must taper in amplitude to essentially zero at the walls, and there is therefore one-half cycle of amplitude distribution, corresponding to the "1" in the subscript. The amplitude taper in the V direction is represented by a lesser number of arrows near the side walls.

Figure 4C:
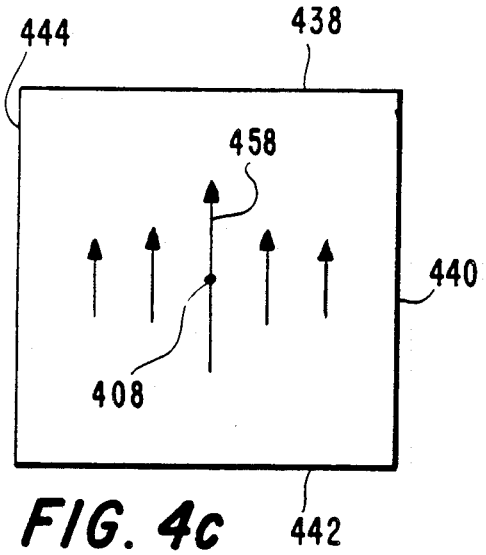
FIG. 4*c* illustrates the superposition of the fields of FIGS. 4*a* and 4*b*, FIGS. 4*a*, 4*b* and 4*c* are together referred to as FIG. 4.

FIG. 4*c* represents the result of vector summation or superposition of the fundamental $TE_{1,0}$ mode of FIG. 4*c* and the $LSE_{1,2}$ mode of FIG. 4*b*. The summation of downwardly-directed arrows 452 and 456 with arrows 450 near the upper and lower walls results in substantial cancellation of the field near the upper and lower walls, and reinforcement of the field near axis 408. In FIG. 4*c*, upwardly-directed arrows 458 representing the E field does not reach upper and lower walls 438 and 442, respectively, thereby suggesting or representing an amplitude taper in the vertical direction. While the arrows end abruptly, the electric field which they represent tapers in amplitude smoothly. Since both the field distributions represented in FIGS. 4*a* and 4*b* taper to zero at the right and left extremes, the distribution on FIG. 4*c* tapers to zero amplitude at the side walls 440, 444.

As mentioned, FIG. 4*b* is representative of the phase of the higher-order $LSE_{1,2}$ mode in waveguide 214 at or very near to plane 212 (FIG. 2). As in the ease of the circular waveguide, the distribution of FIG. 4*c* is the desired amplitude distribution at the radiating aperture, but the radiating aperture cannot conveniently be placed at plane 212. The desired phase relationship recurs at 360° of differential phase from plane 212. This length of different phase velocity propagation tends to limit the bandwidth, and to make the horn large and heavy.

Figure 5B:
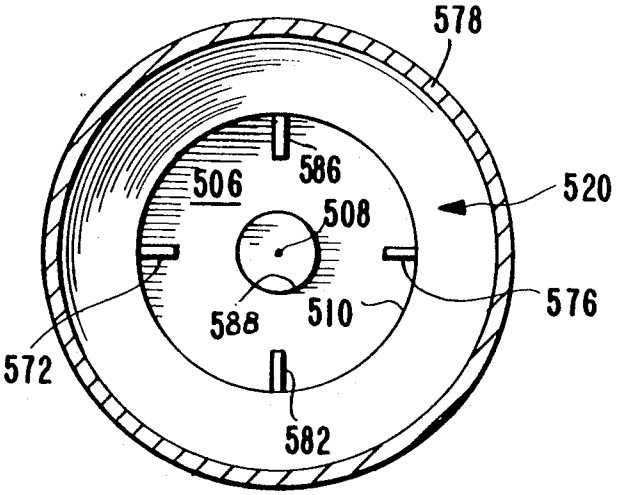
FIG. 5*b* is an end view thereof and FIG. 5*c* is a perspective view, partially cut away, FIGS. 5*a*, 5*b*, 5*c* and 5*d* together are referred to as FIG. 5.
Figure 5A:
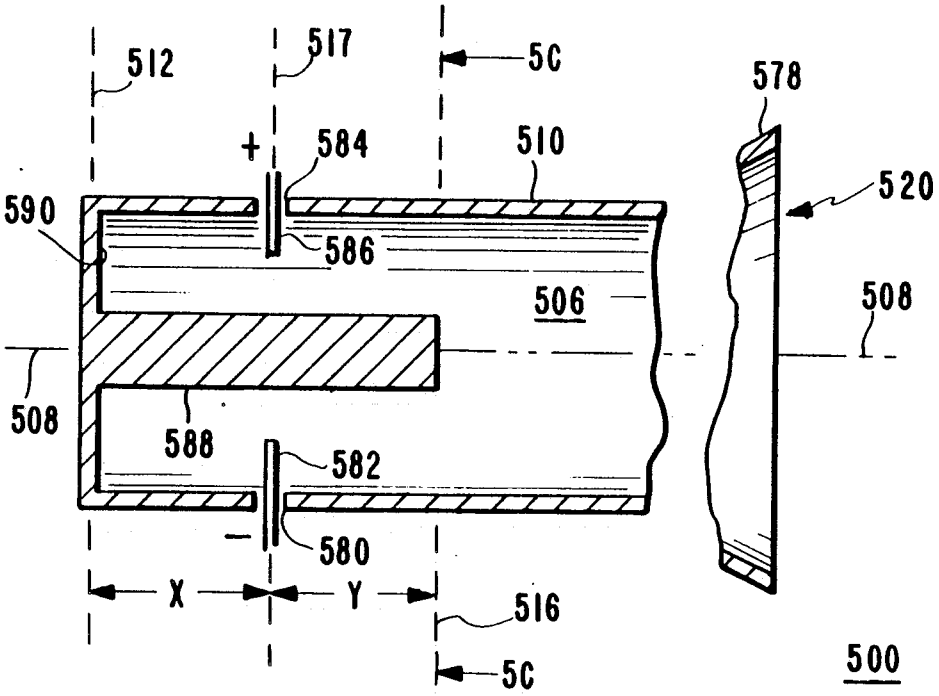
FIG. 5*a* is an elevation cross section of a circular feed waveguide and mode transformer according to the invention, which is illustrated in perspective view in FIG. 5*d*.

FIG. 5*a* is an elevation cross section of a feed arrangement for a radiating aperture according to the invention. FIG. 5*d* is a perspective view of the structure. In FIG. 5*a*, a conductive cylindrical wall 510 defines a hollow waveguide centered on an axis 508. At a transverse plane 512 orthogonal to axis 508, a short-circuiting conductive plate 590 connects with cylindrical wall 510. An elongated center conductor 588 makes contact with conductive plate 590 and extends, centered on axis 508, through the center of the hollow waveguide defined by wall 510 to end abruptly at a transverse plane 516. A push-pull feed arrangement includes an electric probe 586 extending through a hole or aperture 584 in wall 510, together with a second electric probe 582 coaxial with probe 586. Probe 582 extends through a hole or aperture 580 in wall 510 at a location which is diametrically opposite to aperture 584. Electric probes 582 and 586 constitute oppositely poled poles adapted to be driven in antiphase. Both electric probes 582 and 586 lie in, or are centered on, a transverse plane 517 orthogonal to axis 508. Transverse plane 517 lies between transverse planes 512 and 516. As known, electric probes 582 and 586 may be extensions of the center conductors of coaxial cables, the outer conductors of which terminate on conductive wall 510 at locations surrounding apertures 580 and 584, respectively.

The hollow waveguide defined by conductive cylindrical wall 510 may, if desired, be flared into a horn, a portion which is illustrated as 578, to define a circular radiating aperture 520.

FIG. 5*b* is an end view looking into radiating aperture 520. Elements of FIG. 5*b* corresponding to those of FIG. 5*a* are designated by the same reference numerals. FIG. 5*b* also illustrates a second pair of probes 572, 576 extending through apertures into waveguide 506. Both electric probes 572 and 576 lie in transverse plane 517, the same plane in which electric probes 582 and 586 lie.

Figure 5C:
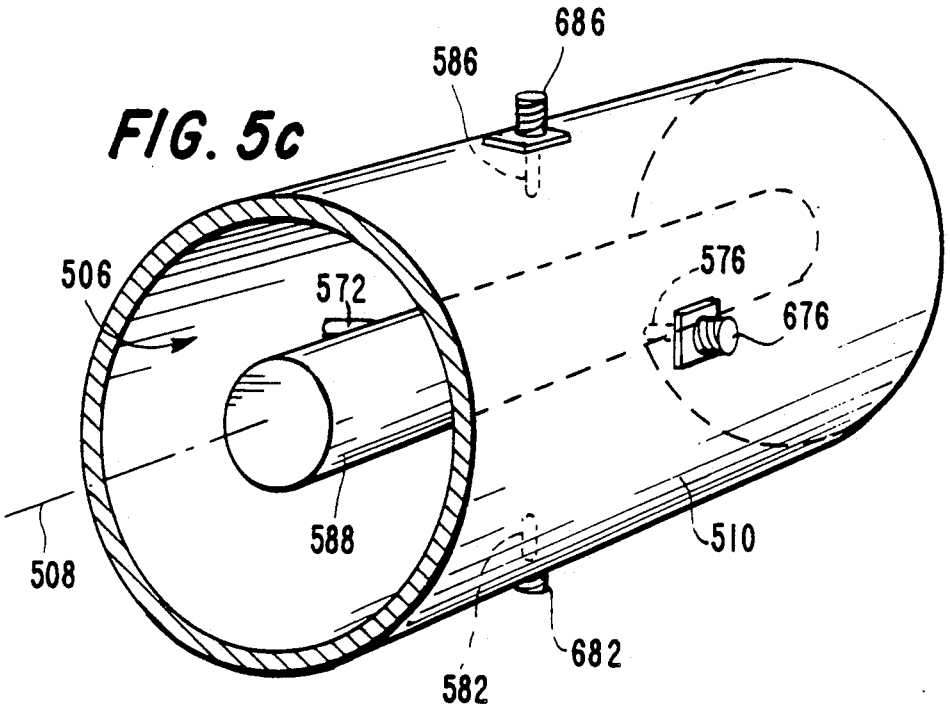
Figure 5D:
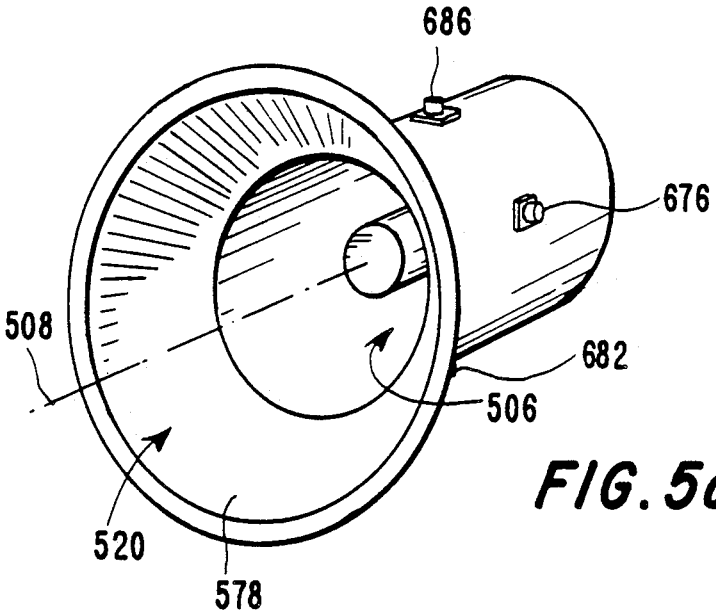

FIG. 5*c* illustrates in perspective view the arrangement of FIGS. 5*a*, looking from transverse plane 516 in the direction of arrows c—c of FIG. 5*a*. Elements of FIG. 5*c* corresponding to those of FIGS. 5*a* and 5*b* are designated by the same reference numerals. In FIG. 5*c*, coaxial connectors 676, 682 and 686 provide contact by their center conductors (not illustrated) to electric field probes 576, 582 and 586, respectively. A similar coaxial connector (not illustrated in FIG. 5*c*) is connected to electric probe 572.

Figure 6A:
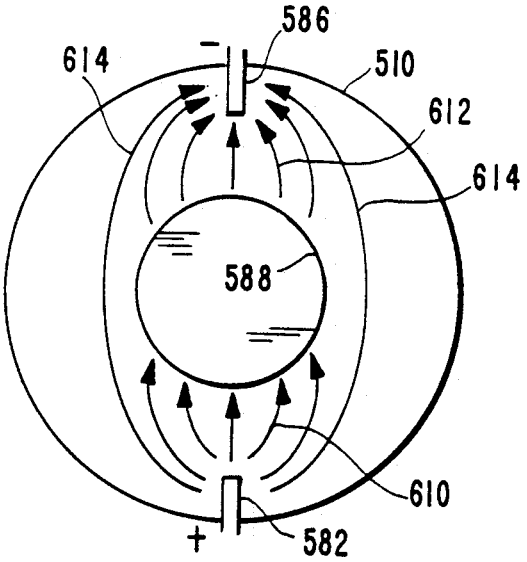
FIG. 6*a* illustrates the electric field configuration within the arrangement of FIG. 5 at a transverse plane near the feed point, the FIGS. 6*b* and 6*c* illustrates the electric field configurations at another transverse plane intersecting the center conductor.

FIG. 6*a* illustrates the instantaneous electric field configuration within hollow waveguide 506 of FIG. 5 at transverse plane 517 when probes 582 and 586 are energized push-pull. In FIG. 6*a*, elements corresponding to those of FIG. 5 are designated by the same reference numerals. FIG. 6*a* is simplified, in that electric probes 572 and 576 are ignored as either not being energized or as being energized in phase quadrature with the energization of probes 582 and 586. Electric probe 586 is illustrated as having an instantaneous negative (−) polarity, and electric probe 582 as having an instantaneous positive (+) polarity. With this polarity, electric field lines illustrated as arrows 610, 612 and 614 extend generally from probe 582 to probe 586. Center conductor 588 lies directly between probe 582 and probe 586. Consequently, some of the electric field lines such as 610 extend from probe 582 to the surface of center conductor 588, and other electric field lines such as 612 extend from the surface of center conductor 588 to probe 586. In addition, other electric field lines such as 614 extend directly from probe 582 to probe 586 in a curved path which does not intersect center conductor 588.

Figure 6B:
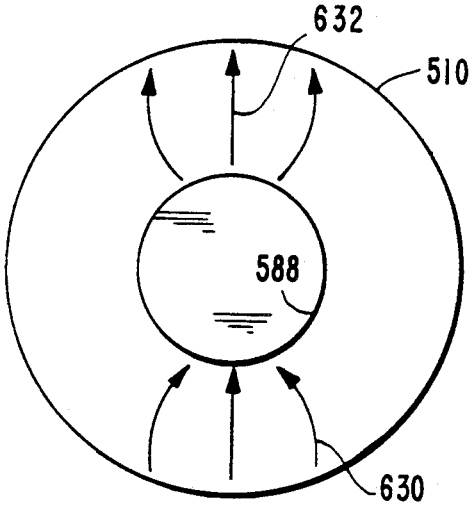
FIGS. 6*c* and 6*d* illustrate two components at yet another transverse plane on the other side of the discontinuity.

FIG. 6*b* illustrates the electric field configuration of the arrangement of FIG. 5 at transverse planes lying between transverse planes 516 and 517. In this region, the electric field lines are decoupled from electric probes 582 and 586, and propagate with the electric field coupled to outer wall 510 and, as illustrated by arrows 630 and 632, to center conductor 588. The electric field associated with arrows 630 and 632 is a coaxial $TE_{1,1}$ mode.

Figure 6D:
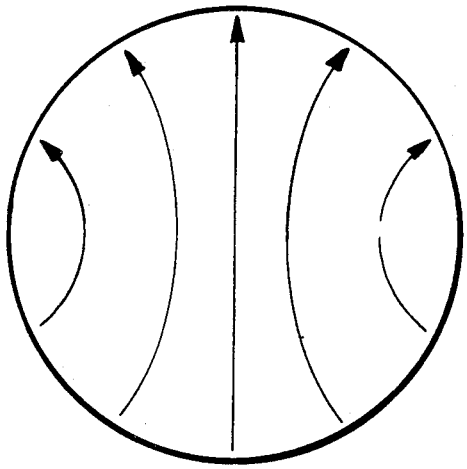
Figure 6C:
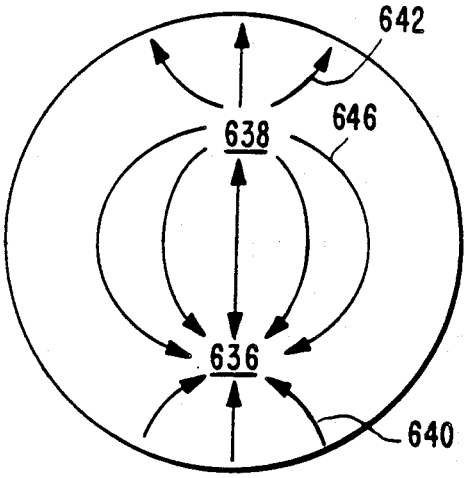

FIGS. 6*c* and 6*d* together illustrate the electric field configuration just to the right of mode transition transverse plane 516 of FIG. 5*a*. At transverse plane 516, the center conductor 588 terminates abruptly. Consequently, the electric field mode represented in FIG. 6*b* by arrows 630 and 632 is converted into two components, a first in a $TM_{1,1}$ mode illustrated in FIG. 6*c* by arrows 640, 642, and 646 and a second in a $TE_{1,1}$ mode as illustrated in FIG. 6*d*. As illustrated, the waveguide $TE_{1,1}$ mode of FIG. 6*d* has the same polarity as that of FIG. 3*a*, while the $TM_{1,1}$ mode of FIG. 6*c* has the opposite polarity of that illustrated in FIG. 3*b*. These two modes coexist simultaneously with the illustrated phases near plane 516 of the discontinuity of FIG. 5*a*.

The mode transition can be explained by noting that a waveguide mode must exist to the right of plane 516 in FIG. 5*a*, and the waveguide mode should include at least portions which continue the distribution of the portion of the center-conductor-related electric field mode illustrated by arrows 630 and 632 of FIG. 6*b*. Such a waveguide mode is illustrated in FIG. 6*c* by arrows 640, 642 and 646. Arrows 640 and 646 have their "heads" terminating on a mode-generated "node" 636. Electric field representative arrows 642 and 646 both have their "tails" terminating at a mode-generated node 638. The electric field arrows 640 and 642 of the higher-order waveguide mode of FIG. 6*c* are in the same direction as, and are effectively a continuation of, that portion of the center conductor related mode represented by electric field arrows 630 and 632 of FIG. 6*b*.

As mentioned, the waveguide mode illustrated by electric field lines 640, 642 and 646 of FIG. 6*c* can be recognized as being the same as the $TM_{1,1}$ mode of FIG. 3*b*, but of opposite polarity, corresponding to a 180° phase shift. The relative phases of the $TM_{1,1}$ component (arrows 640, 642, 646) of FIG. 6*c* and the $TE_{1,1}$ mode as illustrated in FIG. 6*d* are reversed from that desired at the radiating aperture. Consequently, only a 180° differential phase shift will suffice to bring the two components into the desired phase. The desired relative phase at the radiating aperture is the same as that illustrated in FIGS. 3*a* and 3*b*. The radiating aperture, therefore, may be at 180° from the mode generating transition rather than 360° therefrom, resulting in the potential for a smaller, lighter horn, and also providing increased instantaneous bandwidth.

Figure 7B:
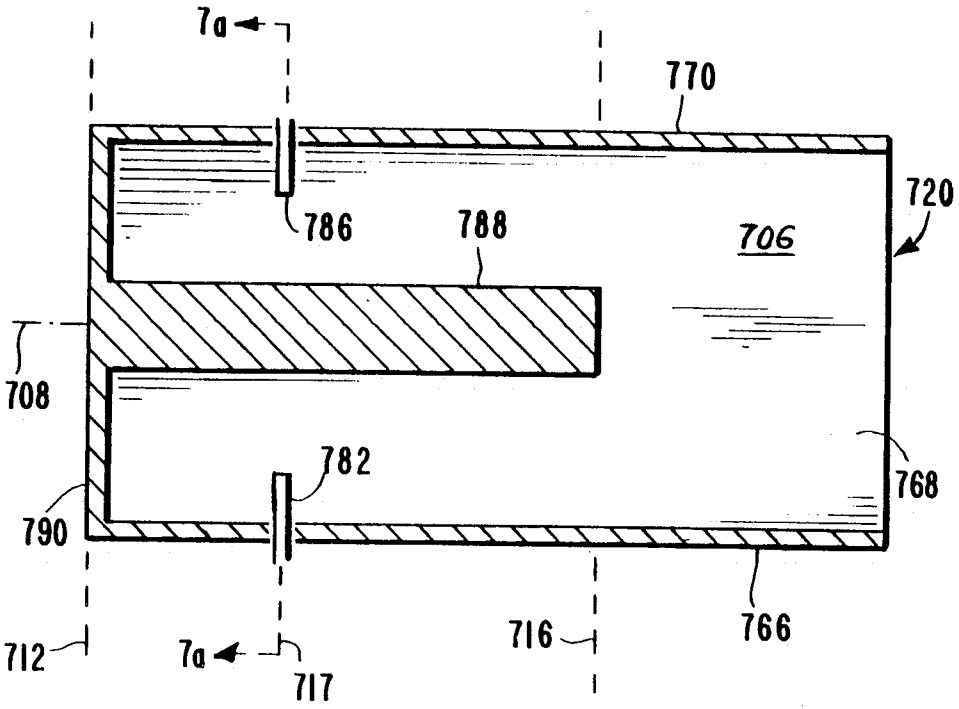
FIG. 7*b* is an elevation cross section of the feed and mode transition portions of a rectangular waveguide horn antenna according to the invention.
Figure 7A:
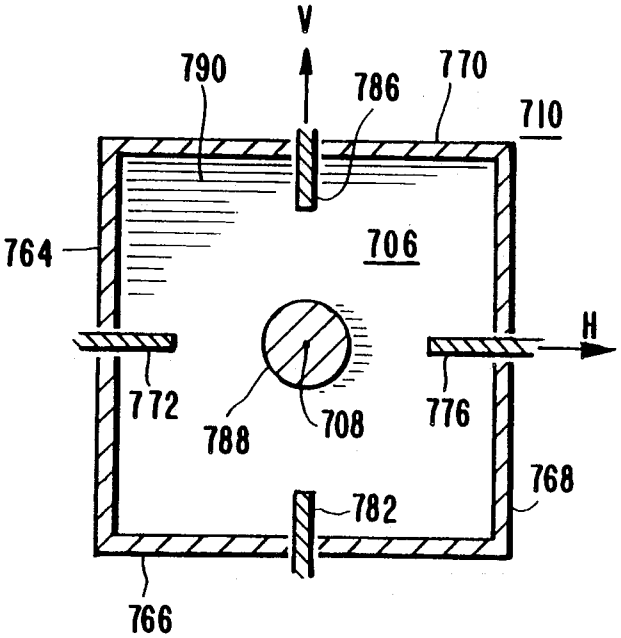
FIG. 7*a* is an end view thereof.

FIG. 7*a* illustrates a view looking into the radiating aperture of a square waveguide 706 defined by a conductive wall arrangement 710 including walls 764, 766, 768 and 770 centered on a longitudinal axis 708. FIG. 7*b* is an elevation cross-section of the structure of FIG. 7*a*. At a transverse plane 717, a pair of electric field probes 782, 786 lie in a vertical plane on diametrically opposite sides of axis 708 and pass through apertures centered on sides 766, 770, respectively Similarly, a second pair of electric field probes 772, 776 pass through apertures (not illustrated) centered in the sides of conductive walls 764, 768, respectively. A short-circuiting plate 790 joins all four walls 710 at a transverse plane 710 orthogonal to axis 708. A center conductor 788 makes conductive contact with short-circuiting plate 790 and extends, centered on axis 708, to an abrupt termination at transverse plane 716. This is the square-waveguide equivalent of the circular-waveguide arrangement of FIG. 5.

Figure 8A:
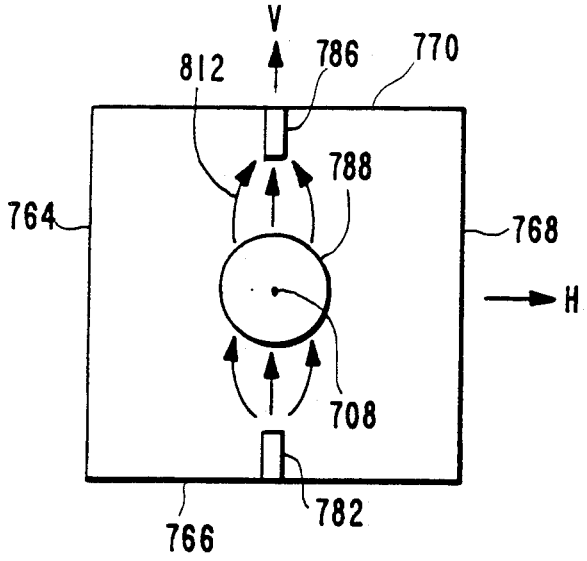
FIGS. 8*a*, *b*, *c*, and *d* illustrate the electric field configuration or components thereof at various cross-sections within the arrangement of FIG. 7.
Figure 8B:
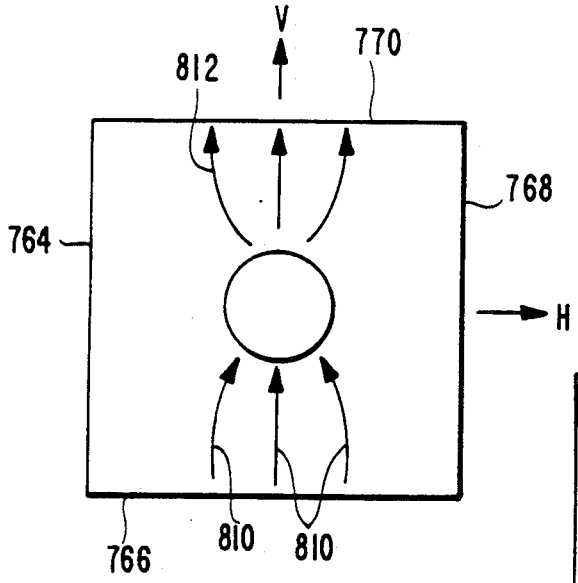
Figure 8D:
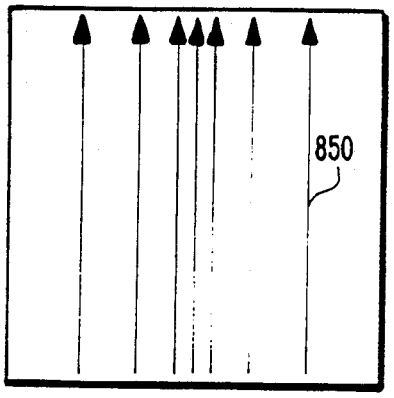
Figure 8C:
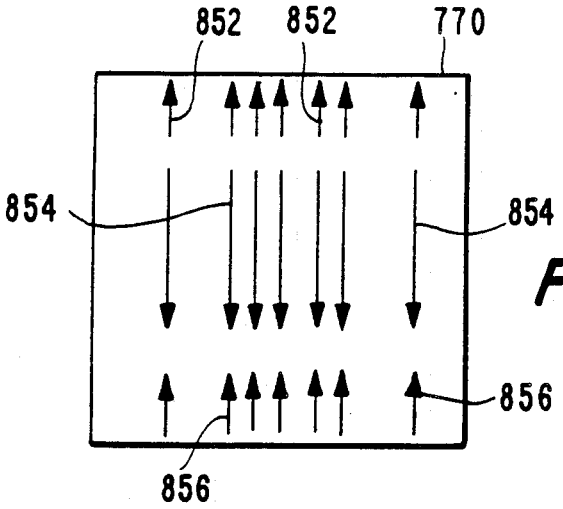

FIGS. 8*a*, 8*b* and 8*c* illustrate the electric field distribution at transverse plane 717 of FIG. 7*b*. In FIG. 8*a*, the field includes electric field lines represented by arrows 810 and 812 extending from probe 782 to center conductor 788, and from center conductor 788 to probe 786, respectively. FIG. 8*b* illustrates the field distribution at a location between planes 716 and 717 of FIG. 7*b* but near plane 916. In FIG. 8*b*, arrows 810 and 812 terminate on lower and upper walls 766 and 770, respectively, representing decoupling of the field from the probes. At the abrupt termination of the center conductor of FIG. 7*b* at plane 716, two waveguide modes are generated. The $LSE_{1,2}$ mode is generated at plane 716, as illustrated in FIG. 8*c*, and the $TE_{1,0}$ mode is also generated, as illustrated in FIG. 8*d*. As illustrated in FIGS. 8*c* and 8*d*, the $LSE_{1,2}$ mode is 180° out of phase with the $TE_{1,0}$ mode relative to that illustrated in FIGS. 4*a* and 4*b*. In particular, arrows 854 of FIG. 8*c* are oppositely directed relative to arrows 850 of FIG. 8*d*, and arrows 852 and 856 are in the same direction. This is not the phase desired at the radiating aperture, but 180° therefrom. Consequently, only 180° of differential phase is necessary between the mode generating transition and the radiating aperture. As mentioned, this has advantages in size, weight and instantaneous bandwidth.

FIG. 9*a* illustrates, partially in block and partially in perspective view, a drive arrangement for energizing the electric probes of the antenna arrangement of either FIGS. 5 or 7 to produce circular polarization. In FIG. 9*a*, signal to be radiated is applied by way of a terminal 910 and a cable illustrated as 910 to a directional coupler 914. Directional coupler 914 includes a matched termination 916, and also includes 0° and 90° output terminals 918 and 920, respectively. The 0° signal from output terminal 918 is applied over a cable 922 to a phase splitter illustrated as a block 924, and the signal from output terminal 920 is applied over a cable 926 to a phase splitter illustrated as a block 928. Phase splitter 924 produces a 0° reference signal which is applied over a cable 930 to connector 686 associated with a first electric probe of antenna 500. A second signal having a phase of 180° is applied over a cable 932 to connector 682 of antenna 500, whereby electric probes 582 and 586 (FIG. 5) are driven push-pull. A 90° signal is applied to phase splitter 928 over cable 926. Phase splitter 928 splits the phase, and a relative 90° signal is applied over a cable 934 to a connector 672- associated with probe 572 (FIG. 5), and a relative 270° is applied over a cable 936 to connector 676 of antenna 500. Thus, electric probes 572 and 576 (FIG. 5) are driven in antiphase, but relatively in quadrature to the drive of probes 586 and 586'.

FIG. 9*b* illustrates phase splitter 924 in schematic form. Elements of FIG. 9*b* corresponding to those of FIG. 9*a* are designated by the same reference numerals. A coaxial input port 950 is coupled across the primary winding 952 of a transformer designated generally as 954. A center-tapped secondary winding 956 having its center-tap grounded is magnetically coupled to primary winding 952 for producing relatively antiphase signal voltages at a first end for application to the center conductor of coaxial cable 932, and for producing a relatively in-phase signal at a second end for application to the center conduction of coaxial cable 930. Transformers with windings on miniature toroidal coils can readily be used up to about 1GHz, and equivalent distributed transformer structures are usable at much higher frequencies.

Other embodiments of the invention will be apparent to those skilled in the art. For example, the pairs of electric field probes may be located at different transverse planes, if desired. Other arrangements may be used for exciting fields in the illustrated modes, such as magnetic coupling loops. The feed cables may be coupled through the center of a hollow center conductor, with the electric probes projecting through holes in the wall of the center conductor rather than through the exterior waveguide walls. Conductive short-circuiting wall 590 may be made movable relative to the remainder of the structure to provide for tuning. Similarly, center conductor 588 or 788 may extend through short-circuiting plate 590, 790, making sliding contact thereto, and movable so that the position of the abrupt termination relative to the feed point can be selected to optimize the mode transition. Provisions may be made for tuning the electric probes for optimizing coupling to the region with the waveguide. While the waveguide has been described as hollow, it may contain a gas or dielectric solid and still be considered hollow as to the electromagnetic fields. The cross-sectional shape of the center conductor need not be a circle, it could be polygonal or stranded. While 180° differential phase has been described, the length of guide may correspond to $180° + N \times 360°$, where N is an integer.

What is claimed is:

1. A horn antenna arrangement, comprising:

a hollow waveguide including a conductive peripheral wall arrangement centered on a longitudinal axis;

a conductive short circuiting plate connected to said peripheral wall arrangement at a first plane transverse to said axis;

an elongated conductor connected at one end to said short circuiting plate and extending within said waveguide and centered on said axis to an abrupt termination at a second plane transverse to said axis, said elongated conductor being electrically isolated from said conductive peripheral wall arrangement at transverse planes other than said first plane;

push-pull feed means coupled to said hollow waveguide at a third transverse plane lying between said first and second transverse planes, for transducing a signal with said waveguide with first and second antiphase electric poles at diametrically opposite sides of said axis; and a radiation aperture centered on said axis and defined at an extension of said hollow waveguide said radiation aperture being separated by a predetermined distance from said second plane which is selected to provide a phase difference of 180° between a fundamental waveguide mode and a higher-order waveguide mode at said radiating aperture for tending to equalize the radiation patterns in two orthogonal planes.

2. An arrangement according to claim 1 wherein said hollow waveguide is square, and said peripheral wall arrangement includes first, second, third and fourth elongated conductive walls joined in pairs along edges thereof, and wherein said push-pull feed means comprises first and second electric probes extending orthogonally through said first and third walls in an insulated manner.

3. An arrangement according to claim 2 wherein said hollow waveguide includes a flared portion.

4. An arrangement according to claim 1 wherein said hollow waveguide is circular, and said peripheral wall arrangement includes a cylindrical conductive wall, and wherein said push-pull feed means comprises first and second electric probes extending orthogonally through said wall in an insulated manner at first and second diametrically opposed locations.

5. An arrangement according to claim 4 wherein said hollow waveguide includes a flared portion.

6. A method for generating a radiated field, comprising the steps of:

generating a coaxial field propagating mode in a hollow conductive structure coaxial with and electrically isolated from a center conductor;

converting a portion of said coaxial field propagating mode to a higher-order waveguide field propagating mode at a particular transverse plane of said hollow conductive structure having a center conductor;

propagating said fundamental waveguide mode and said higher-order mode for a length corresponding to a differential phase of 180° plus the product of N multiplied by 360°, where N is an integer, to form a net field distribution which is tapered in amplitude; and generating a radiated field having characteristics determined by said net field distribution.

7. A method according to claim 6 wherein N is zero.

* * * * *